United States Patent [19]

Duffy

[11] 4,181,295

[45] Jan. 1, 1980

[54] BOX SETTING TOOL

[76] Inventor: Eugene P. Duffy, 1025 Lowry Ave. N.E., Minneapolis, Minn. 55418

[21] Appl. No.: 929,334

[22] Filed: Jul. 31, 1978

[51] Int. Cl.[2] ..... B25B 21/20

[52] U.S. Cl. ..... 269/3; 269/254 R; 269/321 S

[58] Field of Search ..... 269/1-3, 269/254 R, 321 S, 41, 43; 81/420, 5.1; 33/DIG. 10

[56] References Cited

U.S. PATENT DOCUMENTS

| | | | |
|---|---|---|---|
| 2,956,798 | 10/1960 | Briggs | 33/DIG. 10 |
| 3,617,044 | 11/1971 | Strange | 269/6 |

*Primary Examiner*—Robert C. Watson

*Attorney, Agent, or Firm*—Burd, Braddock & Bartz

[57] ABSTRACT

A box setting tool includes a flat, relatively thin box holding blade adapted to be positioned against a flat edge wall of an electrical junction box or switch box. Two box holding fingers are integral with the box holding blade and extend generally parallel to the box holding blade. They are curved so as to permit a flat edge wall of a junction box to be forced between them and the holding blade thus to holdingly position the junction box with respect to the tool. A transversely extending box positioning bar is fixedly positioned between the holding blade and the holding fingers and is provided with a box wall positioning edge situated to receive the forward flat face of the junction box edge wall. A stud contact blade is fixedly mounted with respect to the holding blade on a side thereof opposite the positioning bar and is provided with a stud contacting face extending outwardly from the holding blade at right angles to it. The distance along the box holding blade from the plane of the stud contacting face of the stud contact blade to the box wall positioning edge of the box positioning bar is selected to be commensurate with the thickness of the plasterboard which will later be nailed on the wall stud face so that after the junction box is installed with the tool in contact with the wall stud and holding junction box, the forward edge of the junction box will be situated flush with the surface of the plasterboard.

4 Claims, 6 Drawing Figures

BOX SETTING TOOL

BACKGROUND OF THE INVENTION

This invention has relation to the installation of electrical junction boxes, both switch boxes and outlet boxes in the construction of housing and of the precise placement of those boxes against vertical wall studs; joists and other structural members in the interior walls of such housing so that the leading or forward edge of the junction boxes will extend out from the faces of these structural members a distance commensurate with the thickness of the plasterboard which is to be later installed to form the interior surface of the wall or ceiling.

What the electrical construction worker needs is a jig or tool which can be instantaneously installed on the junction box and which will allow the worker to substantially instantaneously position the junction box/tool combination against the vertical wall stud or the like and to hold it there with one hand while he uses the other hand to drive nails through provided portions of the junction box into the vertical wall stud, for example, to permanently determine the final positioning of the junction box with respect to the wall stud.

A number of such tools have been designed, with varying degrees of effectiveness and success.

It has been suggested to provide a very large flat blade with a handle and to cut away a central portion of the blade to receive a junction box. Upstanding arms extend from the blade and are provided with resilient fingers to clip onto the outer edges of the junction box to hold it recessed with respect to the blade. The other side of the blade is provided with an adjustable backup plate to be held against the front surface of the wall stud, and a spring loaded member is provided to attempt to temporarily affix the entire tool and box with respect to the vertical wall stud. See the patent to Crawford, U.S. Pat. No. 3,154,304 granted in October of 1964.

It has been proposed to grip an electrical junction box with the jaws of tongs, the tongs extending into the junction box by the distance which the front face of the junction box is to extend beyond the vertical wall stud. The tongs in the junction box are then held up against the wall and the junction box is nailed into place. See the patent to Estep, U.S. Pat. No. 3,601,386 granted in August of 1971.

A guide for locating a switch box at the proper height above the floor and to extend out from a wall stud a proper distance is shown in the patent to Hull, U.S. Pat. No. 3,875,669 granted in April of 1975.

A jig for supporting an electrical outlet box which is releasably attached to the vertical wall stud and provides an adjustable support for holding the outlet box at a selected position out from the wall is shown in U.S. Pat. No. 3,436,070 to Utley granted in April of 1969. It utilizes magnetic retaining means to prevent the movement of the outlet box with respect to the jig.

A search was made on the invention herein, and, in addition to the patents set out above, the following patent was located. U.S. Pat. 3,678,588 to Isola granted in July of 1972. It is not believed to be particularly pertinent.

The inventor and those in privity with him know of no closer prior art and know of no prior art which anticipates the claims made for the invention herein.

With the advent of plastic junction boxes having pre-attached positioning nails therein, certain techniques for providing fixtures for use with metallic junction boxes are no longer applicable or satisfactory. For example, the junction box must be precisely positioned correctly the first time. It is virtually impossible or at least extremely difficult to withdraw the nails from a wall stud through the plastic junction box without destroying the junction box. Obviously, magnetic elements have no effect on the plastic junction box. With the nails prepositioned in the box, the installer can work much more quickly, so cutting down the time of installation of the jig or tool on the junction box and removal of it from the junction box is increasingly important.

Accuracy and care must be used in driving the nails through the junction box into the wall stud, as a missed blow of the hammer against the junction box will very likely destroy the box or severely damage it. For this reason, it is important that the tool be removed from the box and the wall stud just as soon as possible in the sequence of driving the nails through the box into the wall stud.

BRIEF SUMMARY OF THE INVENTION

A box setting tool includes a flat junction box holding blade having a handle extending outwardly therefrom.

A transversely extending stud contact blade extends outwardly with respect to one side of the junction box-holding blade at 90° therefrom, and a transversely extending box positioning bar is mounted on the other side of the blade in such a manner that the working edge of the box positioning bar is behind the working face of the stud contact blade by an amount equal to the distance which the edge of a junction box is to extend beyond the face of the vertical wall stud to which it is attached.

The relationship of the working edge of the box positioning bar with respect to the working face of a stud contact blade can be fixed to make the tool usable only with a certain predetermined thickness of wall board, or it can be made adjustable so that the tool can be adjusted to be useful with several different thicknesses of wall board.

Resilient fingers, fixedly connected to the body of the tool, extend outwardly in the direction of the junction box holding blade and are so shaped that when the outer end of the junction box holding blade is placed against the side wall of the junction box which is to be affixed to a vertical wall stud, the junction box holding fingers can be slid into contact with the inner side of that junction box wall to hold the tool with respect to the junction box after the leading edge of the junction box wall has been forced up into contact with the working edge of the box positioning bar.

With the tool and junction box so positioned, and utilizing the handle of the tool, the junction box is placed in approximately the position desired with respect to the vertical wall stud, and the forward face of the wall stud is brought into contact with the working surface of a stud contact blade.

Where nails are permanently attached to the junction box, as shown herein, those nails are started into the vertical wall stud or other structural member sufficiently to accurately determine the final positioning of the junction box, and then the tool is withdrawn so that the nails can be hammered home without the tool being in the way.

IN THE DRAWINGS

DESCRIPTION OF PREFERRED EMBODIMENT

Figure 1:
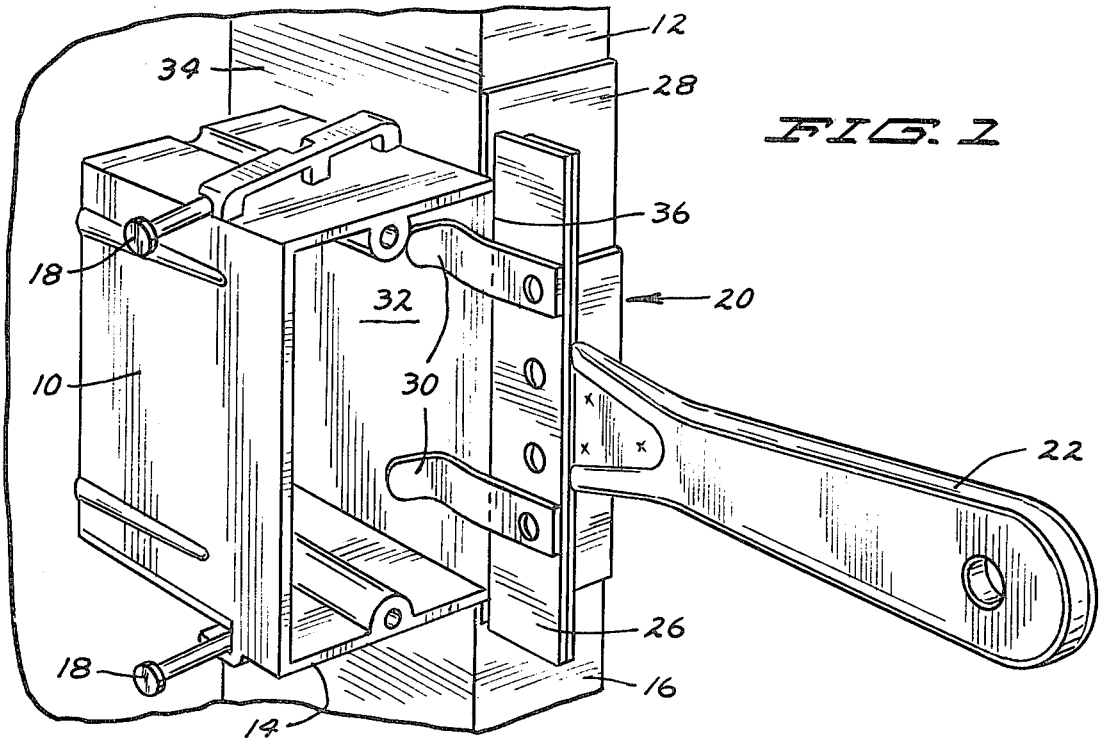
FIG. 1 is a perspective view of a box setting tool of the invention shown in relation to an electrical switch or junction box and a vertical wall stud to which the switch box is to be fastened.

An electrical switch or junction box 10 is to be set with respect to a vertical wall stud 12 so that a leading edge portion 14 of the junction box protrudes from a face 16 of the stud 12 by exactly the thickness of plasterboard (not shown) which will later be nailed onto the face of all of the vertical wall studs in finishing a wall. The electrical installer must so position the junction box 10 with one hand so that he can permanently fasten it with respect to the stud 12 by driving in nails 18,18 which are prepositioned in the junction box.

To so fixedly position the junction box 10, a box setting tool 20 of the invention is provided. It includes a handle 22 and an integrally connected longitudinally extending junction box holding blade 24. Fastened at roughly the junction between the handle 22 and the box holding blade 24 is a transversely extending box positioning bar 26.

A stud contact blade 28 is integral with the handle 22 and the junction box holding blade 24 and extends away from the holding blade 24 at right angles thereto. A pair of resiliently mounted junction box holding fingers 30,30 are integral with the box positioning bar 26 and extend away from that bar to be in operational relationship with respect to the junction box holding blade 24.

Figure 3:
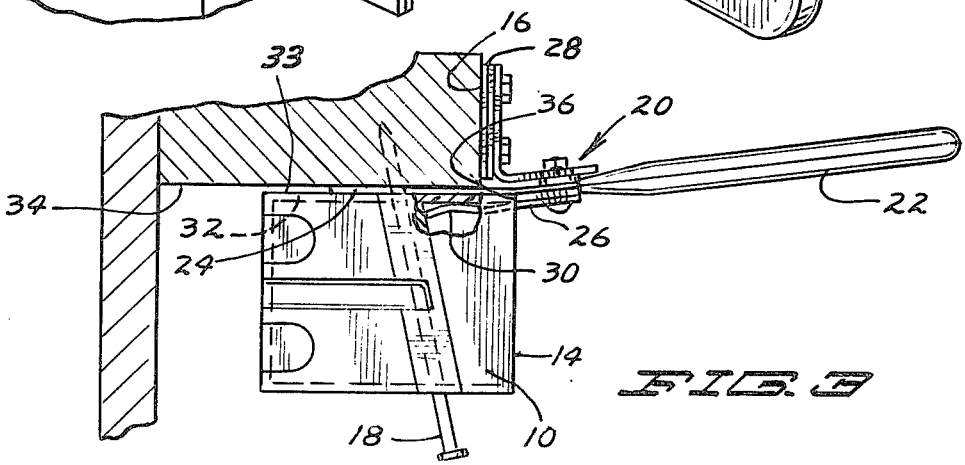
FIG. 3 is a top plan view of the tool and switch box as seen in FIG. 1 with the wall stud shown in section.
Figure 4:
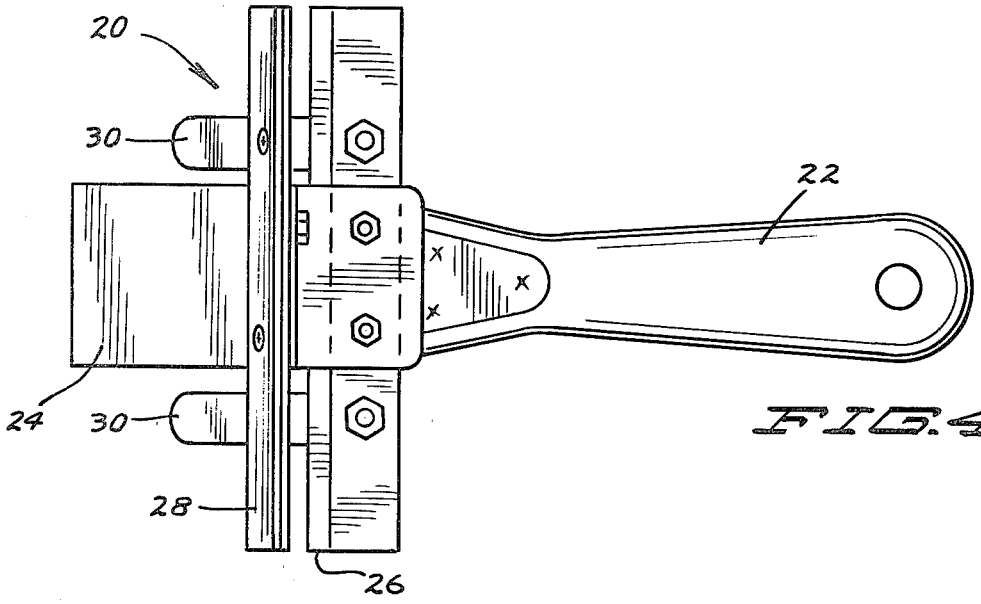
FIG. 4 is a side elevational view of the box setting tool of FIGS. 1 through 3.
Figure 5:
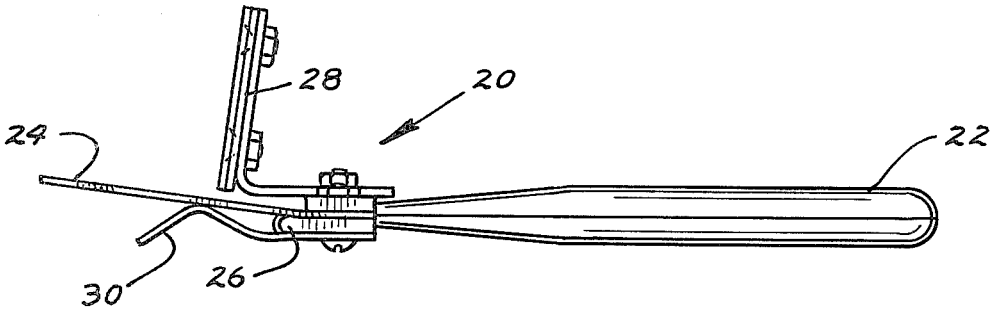
FIG. 5 is a top plan view of the tool of FIG. 4.

As perhaps best understood from consideration of FIG 3, an edge wall 32 of the electrical junction box 10 which is to be permanently positioned against an edge surface 34 of wall stud 12 is provided with an outer surface 33. This wall 32 is forced between the box holding blade 24 and the box holding fingers 30,30 to bring the leading edge portion 14 of the junction box into contact with a working edge of the box positioning bar 26 as indicated at 36 in FIGS. 1 and 3.

Figure 2:
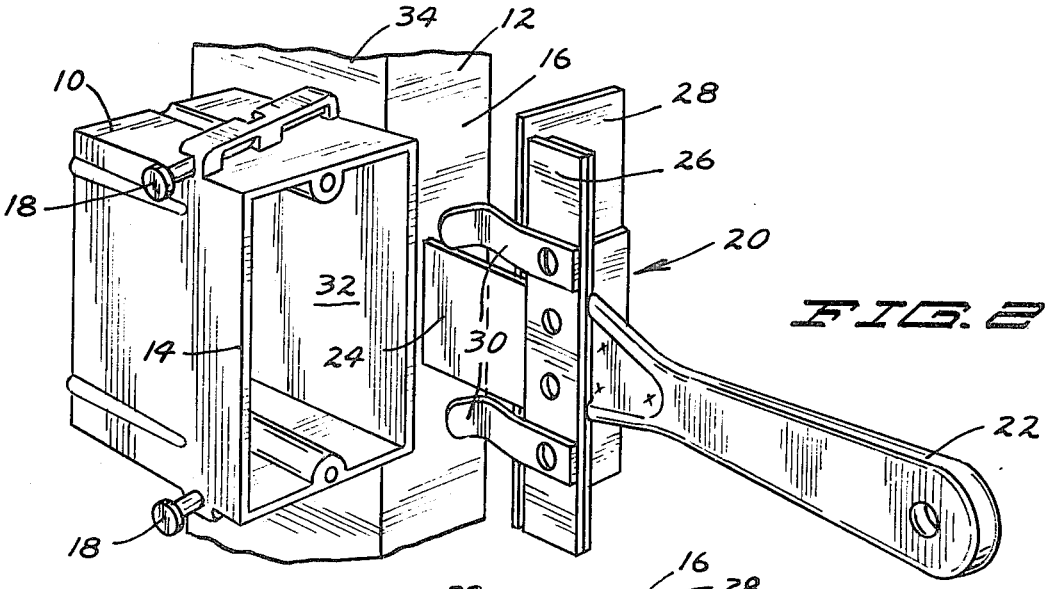
FIG. 2 is a fragmentary perspective view of the elements of FIG. 1 but with the box setting tool of the invention in position as it is first withdrawn from the switch box and stud after the switch box has been partially fastened with respect to the stud.

With the junction box 10 and box setting tool 20 so positioned, utilizing the handle 22 of the tool, the box and tool are positioned with respect to the stud 12 as seen in FIG. 1 or are positioned with respect to a joist or other structural member and are held in that position with one hand while the nails 18,18 are driven part way into the edge surface 34 of the stud 12. With the final location of the box now determined but with the box still loosely fastened with respect to the stud 12, the handle 22 is used to withdraw the box setting tool 20 and specifically the holding blade 24 and the holding fingers 30,30 from the electrical junction box 10 and the stud 12, as indicated and suggested in FIG. 2.

The nails 18,18 can then be driven all the way home to permanently affix the box 10 to the stud 12.

In one form of the invention, the box positioning bar 26 can be integrally and permanently fastened with respect to the stud contacting face of the stud contact blade 28 to be used only with plasterboard of a particular thickness representing the distance along the box holding blade 24 from the stud contacting face of the stud contact blade 28 to the leading or working box contacting edge of the box positioning bar 26.

Figure 6:
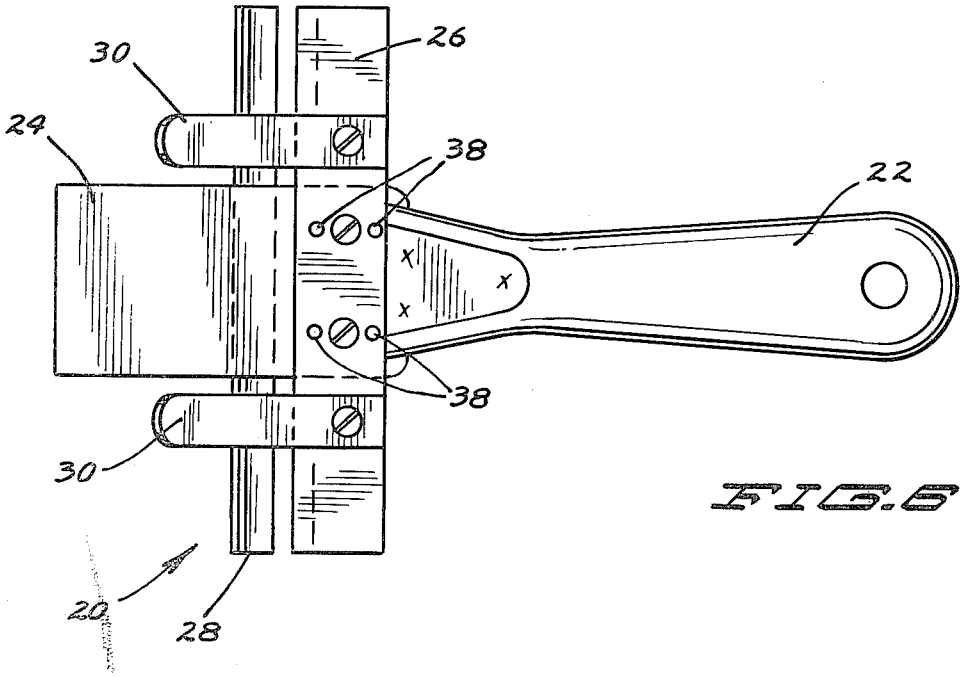
FIG. 6 is a side elevational view of the tool of FIGS. 1 through 5 taken from the side opposite that shown in FIG. 4.

In another form of the invention, however, as shown in FIG. 6, the transversely extending box positioning bar 26 can be temporarily fixedly positioned with respect to the stud contact blade 28, and a series of apertures 38 can be provided in the positioning bar so that the positioning bar can be fastened at several different locations with respect to that stud contact blade to accommodate the use of plasterboard of different thicknesses.

I claim:

1. A box setting tool for temporarily positioning and holding a junction box having at least one edge wall provided with a leading edge portion lying in a plane surface to extend a predetermined distance beyond a wall stud while said box is being at least partially fastened to the wall stud, said tool including:

A. a flat, relatively thin, box holding blade;

B. a handle integral with and extending generally away from said holding blade;

C. at least one box holding finger fixedly attached at a first end thereof with respect to the holding blade, extending generally parallel to the holding blade and shaped and situtated to permit an edge wall of a junction box to be forcibly and holdingly fitted between said finger and said holding blade;

D. a transversely extending box positioning bar fixedly positioned between said holding blade and said holding finger and providing a box wall positioning edge situated to limit the inward movement of said leading edge portion of said box edge wall between said finger and said box holding blade;

E. a stud contact blade fixedly mounted with respect to said holding blade and said box positioning bar to provide a stud contacting face extending outwardly from the holding blade at a side opposite said positioning bar and at right angles to the plane of said box holding blade and parallel to said box positioning edge of said box positioning bar.

2. The box setting tool of claim 1 wherein two spaced-apart box holding fingers are provided in symmetrical relationship on either side of a longitudinal center line of said box holding blade.

3. The box setting tool of claim 2 wherein said box holding fingers are situated outwardly of the outer edges of said box holding blade.

4. The box holding blade of claim 1 and means to adjust the relative positioning of the face of the stud contact blade and the box wall positioning edge of the box positioning bar with respect to each other in the plane of the box holding blade to provide for the positioning of the junction box with respect to the wall stud to have the junction box extend at any one of several predetermined distances beyond the face of the wall stud to accommodate plasterboard of different thicknesses.

* * * * *